US005702284A

United States Patent [19]

Gallegos

[11] Patent Number: 5,702,284

[45] Date of Patent: Dec. 30, 1997

[54] PARTY WHEEL

[76] Inventor: Carlos R. Gallegos, 18125 Antonio Ave., Cerritos, Calif. 90703

[21] Appl. No.: 617,644

[22] Filed: Mar. 19, 1996

[51] Int. Cl.[6] ..... A63H 33/30; G09F 11/18

[52] U.S. Cl. ..... 446/475; 40/515; 248/317

[58] Field of Search ..... 446/5, 475, 483, 446/487, 490, 491; 40/516, 515; 248/317

[56] References Cited

U.S. PATENT DOCUMENTS

| | | | |
|---|---|---|---|
| 434,325 | 8/1890 | Deeves et al. | 40/516 |
| 1,084,636 | 1/1914 | Hunerkopf | 446/475 X |
| 1,163,310 | 12/1915 | Beckley | 40/516 |
| 1,664,401 | 4/1928 | Craig | 446/475 |
| 1,705,190 | 3/1929 | Kincheloe | 40/516 |
| 1,937,911 | 12/1933 | Pajeau | 248/317 X |
| 4,121,720 | 10/1978 | Hayes | 248/317 X |
| 4,787,872 | 11/1988 | Bajo | 446/475 X |

FOREIGN PATENT DOCUMENTS

| | | | |
|---|---|---|---|
| 394024 | 1/1909 | France | 40/515 |

*Primary Examiner*—D. Neal Muir

[57] ABSTRACT

A party wheel including a housing that has a streamer receptacle and a lid. The streamer receptacle has a bottom member and a top edge, with a peripheral wall therebetween. Included are a plurality of rectangular slots. The slots are proportionately spaced along the peripheral wall. Also, a plurality of spindles are interconnected to an interior surface of the bottom member of the streamer receptacle. Each spindle is spaced from a corresponding slot of the peripheral wall of the streamer receptacle, and receives a streamer roller. Each streamer roll may be spun about the spindle, when one end of the streamer roll is pulled through and away from the corresponding slot. The lid is capable of enclosing the plurality of streamer rolls within the housing. The one end of each streamer roll is extended through the slot. Lastly, a swivel hanger is coupled to an upper portion of the lid to allow the housing, with the rolls therein, to suspend from a ceiling.

3 Claims, 3 Drawing Sheets

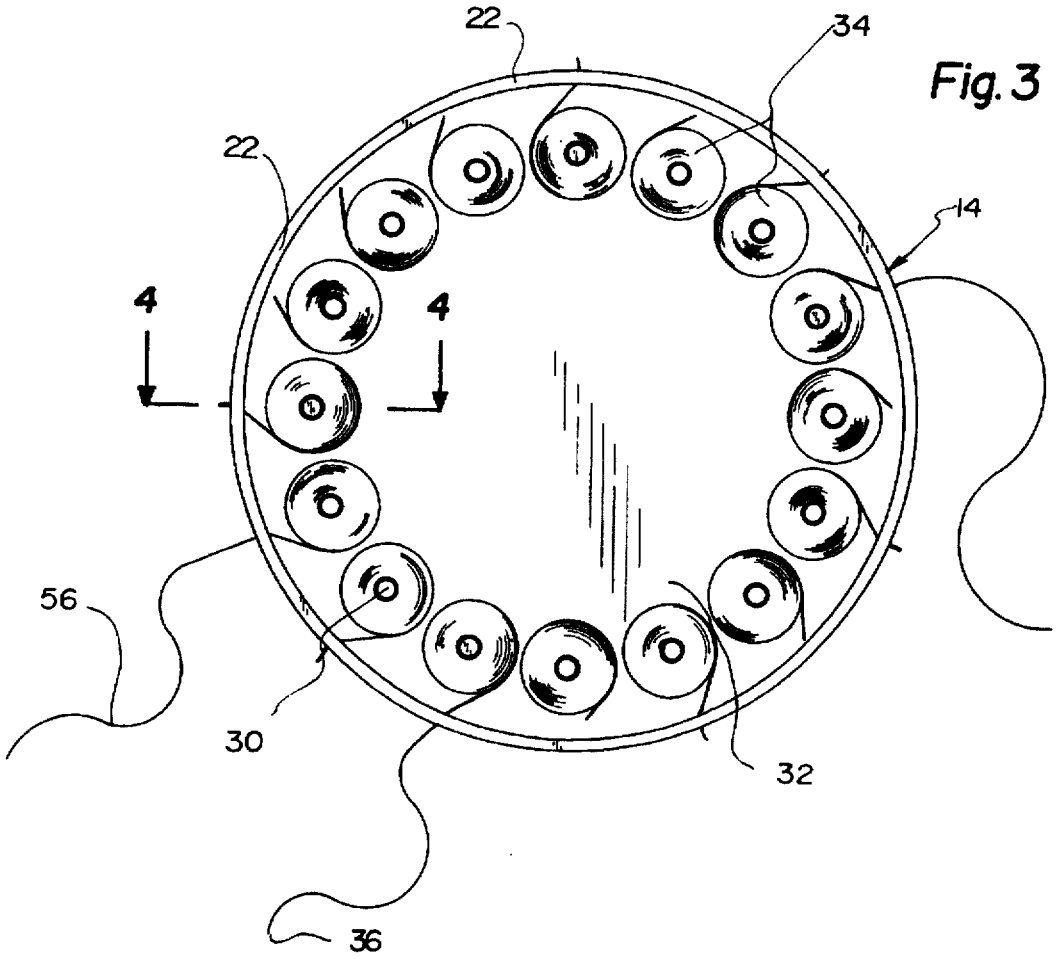
Fig. 3
Fig. 4
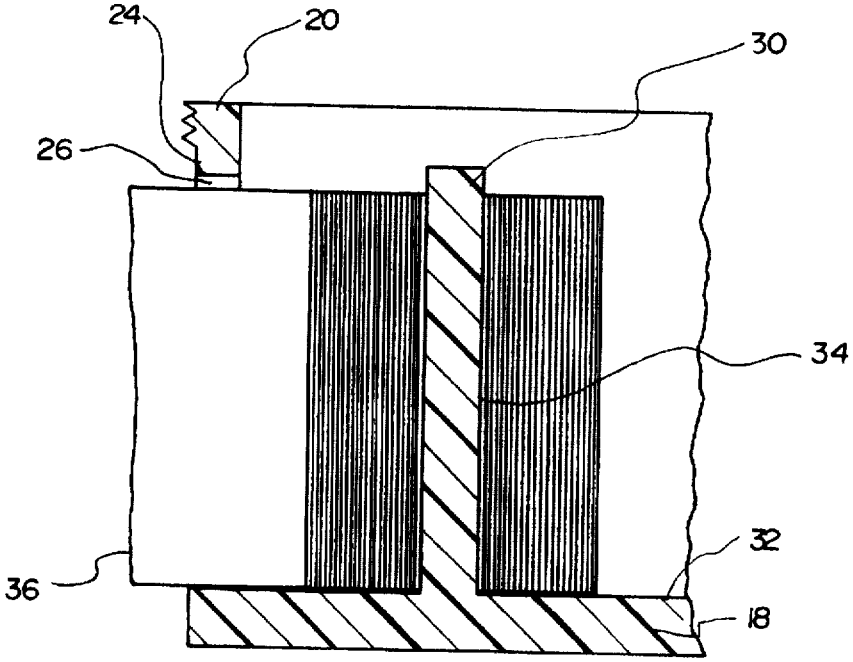

PARTY WHEEL

BACKGROUND OF THE INVENTION

1. Field of the Invention

The present invention relates to a party wheel and more particularly pertains to a decorative holder and dispenser for party streamers, and further allowing the streamers to extend from the party wheel.

2. Description of the Prior Art

The use of party decoration device is known in the prior art. More specifically, party decoration devices heretofore devised and utilized for the purpose of room decoration are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,354,227 to Watkins discloses streamers and bubbles. U.S. Pat. No. Des. 330,876 to Huber discloses a streamer. U.S. Pat. No. Des. 319,419 to Cheng discloses a combined streamer decoration and closure. U.S. Pat. No. 5,004,633 to Lovik discloses a balloon decorative devices, method and kits. U.S. Pat. No. 4,088,275 to Ramos discloses a ribbon dispenser. Lastly, U.S. Pat. No. 3,861,614 to Horak discloses a demountable ribbon wheel.

While these devices fulfill their respective, particular objectives and requirements, the aforementioned patents do not describe a party wheel that allows a plurality of streamer rolls to be placed in a housing for dispensing across a room, when the housing is suspended from the ceiling.

In this respect, the party wheel according to the present invention substantially departs from the conventional concepts and designs of the prior art, and in doing so provides an apparatus primarily developed for the purpose of a decorative holder and dispenser for party streamers, and further allowing the streamers to extend from the party wheel.

Therefore, it can be appreciated that there exists a continuing need for a new and improved party wheel which can be used for a decorative holder and dispenser for party streamers, and further allowing the streamers to extend from the party wheel. In this regard, the present invention substantially fulfills this need.

SUMMARY OF THE INVENTION

In view of the foregoing disadvantages inherent in the known types of party decoration devices now present in the prior art, the present invention provides an improved party wheel. As such, the general purpose of the present invention, which will be described subsequently in greater detail, is to provide a new and improved party wheel and method which has all the advantages of the prior art and none of the disadvantages.

To attain this, the present invention essentially comprises a generally cylindrical housing that has a streamer receptacle and a lid. The streamer receptacle has a bottom member and a top edge with a peripheral wall therebetween. The peripheral wall is interconnected to the bottom member. The peripheral wall is rigid and has a threaded top portion adjacent the top edge. Included are a plurality of rectangular slots that are proportionately spaced along the peripheral wall. Each slot is in a vertical orientation with respect to the bottom member and top edge of the streamer receptacle. Each slot extends vertically between the bottom member and the threaded top portion of the streamer receptacle. A plurality of spindles are interconnected to an interior surface of the bottom member of the streamer receptacle. Each spindle is generally cylindrical and has a height greater than a length of each slot of the peripheral wall. Each spindle is spaced from a corresponding slot of the peripheral wall of the streamer receptacle. Each spindle receives a streamer roll rotatably positioned thereon. One end of each streamer roll is threadable through the slot corresponding to the spindle supporting the streamer rolls. Each streamer roll is spun about the spindle, when the one end of the streamer roll is pulled through and away from the corresponding slot. The lid has an upper portion with a threaded projecting flange. The flange of the lid is capable of engaging the threaded portion of the peripheral wall of the streamer receptacle. The lid is capable of enclosing the plurality of streamer rolls within the housing. Lastly, a swivel hanger is coupled to the upper portion of the lid with a coupler. The coupler is positionable through an axial bore of the lid. The swivel hanger has an eyelet that is capable of allowing the housing, with the rolls therein, to suspend from a ceiling. The swivel hanger allows the housing the rotate 360 degrees thereabout for release of streamers from the streamer rolls contained within. Each streamer of the streamer roll is capable of being located across a room where the housing is suspended.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved party wheel which has all of the advantages of the prior art party decoration devices and none of the disadvantages.

It is another object of the present invention to provide a new and improved party wheel which may be easily and efficiently manufactured and marketed.

It is further object of the present invention to provide a new and improved party wheel which is of durable and reliable constructions.

An even further object of the present invention is to provide a new and improved party wheel which is susceptible of a low cost of manufacture with regard to both materials and labor, and which accordingly is then susceptible of low prices of sale to the consuming public, thereby making such party wheel economically available to the buying public.

Still yet another object of the present invention is to provide a new and improved party wheel which provides in the apparatuses and methods of the prior art some of the advantages thereof, while simultaneously overcoming some of the disadvantages normally associated therewith.

Even still another object of the present invention is to provide a party wheel for a decorative holder and dispenser for party streamers, and further allowing the streamers to extend from the party wheel.

Lastly, it is an object of the present invention to provide a new and improved party wheel including a housing that has a streamer receptacle and a lid. The streamer receptacle has a bottom member and a top edge, with a peripheral wall therebetween. Included are a plurality of rectangular slots. The slots are proportionately spaced along the peripheral wall. Also, a plurality of spindles are interconnected to an interior surface of the bottom member of the streamer receptacle. Each spindle is spaced from a corresponding slot of the peripheral wall of the streamer receptacle, and receives a streamer roller. Each streamer roll may be spun about the spindle, when one end of the streamer roll is pulled through and away from the corresponding slot. The lid is capable of enclosing the plurality of streamer rolls within the housing. The one end of each streamer roll is extended through the slot. Lastly, a swivel hanger is coupled to an upper portion of the lid to allow the housing, with the rolls therein, to suspend from a ceiling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top plan view of the present invention taken along line 3—3 of FIG. 1.

FIG. 4 is an enlarged cross sectional view of the present invention taken along line 4—4 of FIG. 3.

The same reference numerals refer to the same parts through the various Figures.

DESCRIPTION OF THE PREFERRED EMBODIMENT

Figure 1:
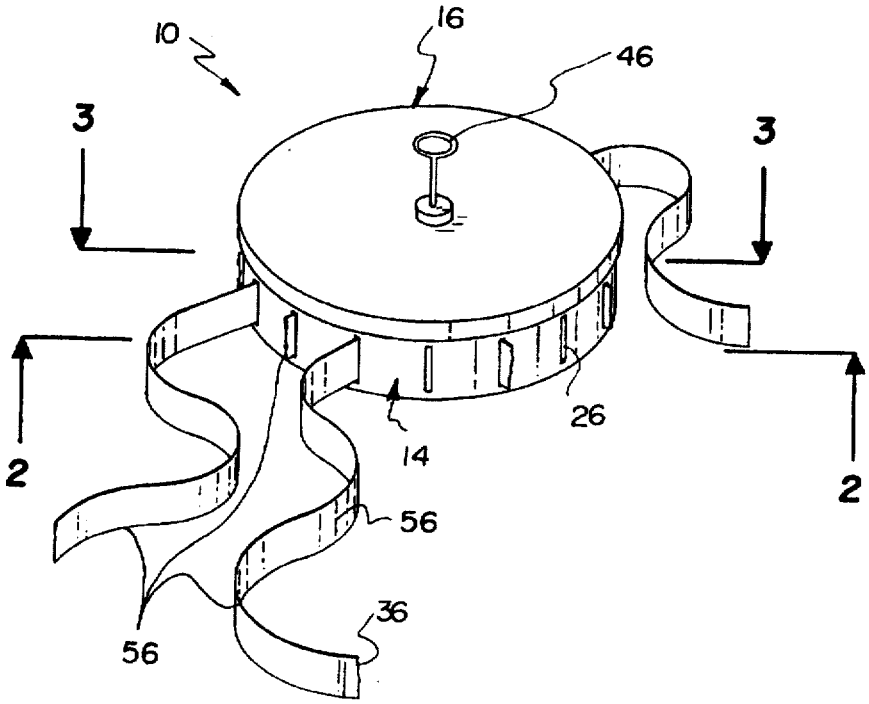
FIG. 1 is a perspective view of the preferred embodiment of the party wheel constructed in accordance with the principles of the present invention.
Figure 2:
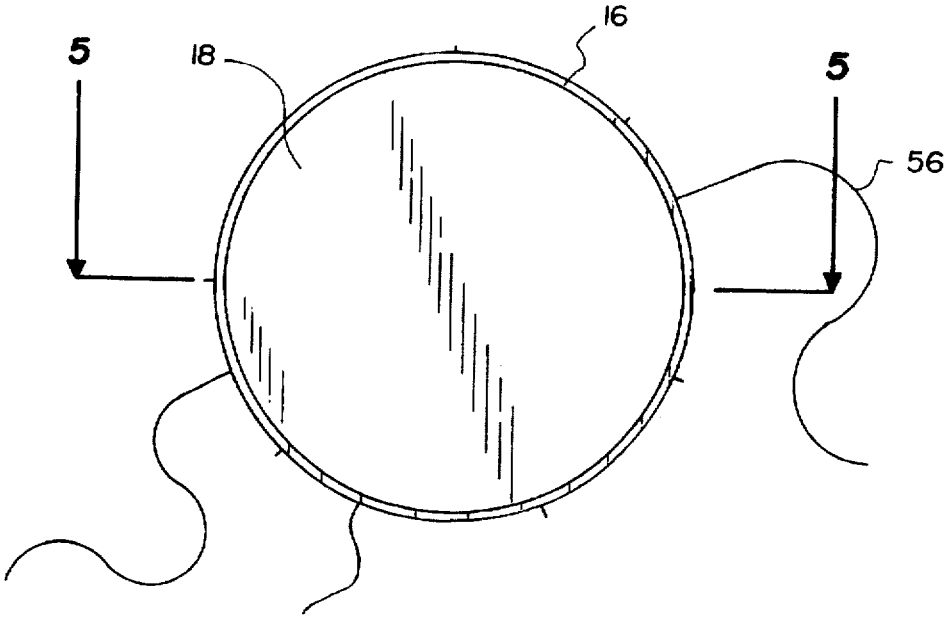
FIG. 2 is a rear elevational view of the present invention taken along line 2—2 of FIG. 1.

With reference now to the drawings, and in particular to FIG. 1 thereof, the preferred embodiment of the new and improved party wheel embodying the principles and concepts of the present invention and generally designated by the reference numeral 10 will be described.

The present invention, the party wheel 10 is comprised of a plurality of components. Such components in their broadest context include a housing, slots, spindles and a swivel hanger. Such components are individually configured and correlated with respect to each other so as to attain the desired objective.

Specifically, the present invention includes a generally cylindrical housing 10. The housing, as shown in FIG. 1, has a streamer receptacle 14 and a lid 16. The streamer receptacle has a bottom member 18 and a top edge 20, with a peripheral wall 22 therebetween. The peripheral wall is interconnected to the bottom member, as seen in FIG. 1. The peripheral wall is rigid. The peripheral wall has a threaded top portion 24 that is adjacent the top edge, as seen in FIG. 4. The housing may be formed of a thermal plastic resin polymer. The housing, as shown in the FIGS. 1 and 3, will accommodate a range of decorative designs and colors. The housing may be decorated to look like a spider, a pumpkin, or a Christmas ornament, to name a few.

Figure 5:
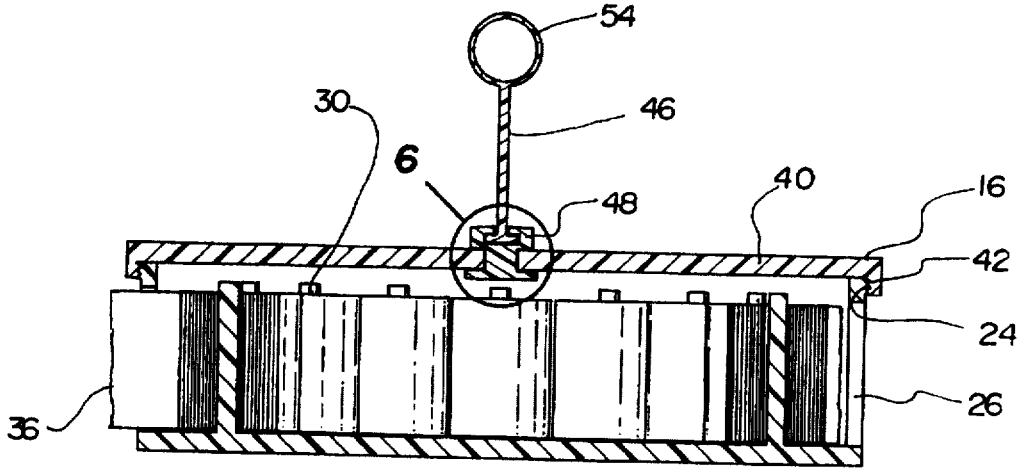
FIG. 5 is a cross sectional view of the present invention taken along line 5—5 of FIG. 2.
Figure 6:
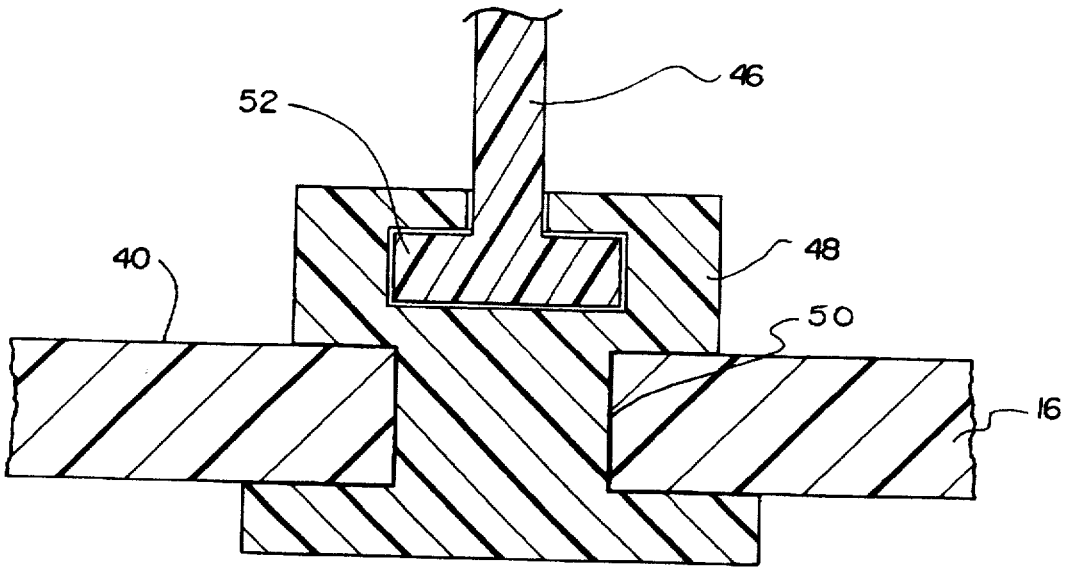
FIG. 6 is an enlarged view of the coupler taken position 6 of FIG. 5.

Also, a plurality of rectangular slots 26 are included, and proportionately spaced along the peripheral wall 22. Each slot is in a vertical orientation with respect to the bottom member 18 and top edge 20 of the streamer receptacle. Each slot extends vertically between the bottom member and the threaded top portion of the streamer receptacle, as seen in FIG. 5. The plurality of slots are preformed in the molding process used to form the housing.

Additionally, a plurality of spindles 30 are interconnected to an interior surface 32 of the bottom member 18 of the streamer receptacle. FIG. 3 shows each spindle is generally cylindrical. FIG. 5 shows each spindle with a height greater than a length of each slot 26 of the peripheral wall. Each spindle is formed of the same plastic used to form the housing 10. Each spindle is spaced from a corresponding slot of the peripheral wall 22 of the streamer receptacle 14. The plurality of spindles are proportionately spaced, along the interior surface, with one spindle spaced from two other spindles. Each spindle is an equal distance from the peripheral wall.

Included are a plurality of streamer rolls 34. Each streamer roll is rotatably positioned on each spindle. One end 36 of each streamer roll is threadable through the slot 26. As seen in FIG. 4, the slot corresponds to the spindle supporting the streamer roll. Each streamer roll is commercially available, and may vary in size and color. Each streamer roll is spun about the spindle when the one end of the streamer roll is pulled through and away from the corresponding slot.

As best illustrated in FIG. 5, the lid 16 has an upper portion 40 with a threaded projecting flange 42 therearound. The flange of the lid engages the threaded portion of the peripheral wall of the streamer receptacle. The lid, when twisted about the threaded top portion, is secured onto the streamer receptacle. The lid encloses the plurality of streamer rolls within the housing, when secured onto the streamer receptacle.

Lastly, a swivel hanger 46 is coupled to the upper portion 40 of the lid with a coupler 48. The coupler is positioned through an axial bore 50 of the lid. The coupler is formed of a flexible material. The swivel hanger has one end 52 positioned within the coupler, and another end has an eyelet 54. The eyelet allows the housing, with the rolls therein, to suspend from a ceiling, when the lid is secured in position. The swivel hanger allows the housing to rotate 360 degrees thereabout for release of streamers 56 from the streamer rolls contained within. By pulling the one end 36, each streamer of the streamer rolls, is located across the room where the housing is suspended.

The present invention is a party wheel that can hold a plurality of rolls of streamers in an upright position on a plurality of spindles. The party wheel has a lid that is threadably secured to a streamer receptacle of the housing. The lid has a swivel hanger that allows the present invention to be suspended from the ceiling of a room. When the present invention is suspended from the ceiling, the ends of the streamer rolls having been feed through slots of the streamer receptacle, are pulled across the room. The end of the streamer rolls may be taped, tacked or tied in place across the room.

The party wheel, of the present invention, can be produced in a range of colors, shapes, and creative motifs to match the party's theme. The party wheel may come ready loaded with a variety of color combinations or it can be reloaded as needed. The streamer rolls are easily spun about the spindles within the housing when pulled across the room. The party wheel of the present invention allows streamers to be easily positioned within the room being decorated, and reduces decoration time.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved party wheel for holding and dispensing decorative streamers comprising in combination:

a generally cylindrical housing having a streamer receptacle and a lid, the streamer receptacle having a bottom member and a top edge with a peripheral wall therebetween, the peripheral wall being interconnected to the bottom member, the peripheral wall being rigid and having a threaded top portion adjacent the top edge;

a plurality of rectangular slots being proportionally spaced along the peripheral wall, each slot being in a vertical orientation with respect to the bottom member and top edge of the streamer receptacle, each slot extending vertically between the bottom member and the threaded top portion of the streamer receptacle;

a plurality of spindles being interconnected to an interior surface of the bottom member of the streamer receptacle, each spindle being generally cylindrical and having a height greater than a length of each slot of the peripheral wall, each spindle being spaced from a corresponding slot of the peripheral wall of the streamer receptacle, each spindle being capable of receiving a streamer roll rotatably positioned thereon, one end of each streamer roll being threadable through the slot corresponding to the spindle supporting the streamer roll, each streamer roll capable of being spun about the spindle when the one end of the streamer roll being pulled through and away from the corresponding slot;

the lid having an upper portion with a threaded projecting flange therearound, the flange of the lid being capable of engaging the threaded portion of the peripheral wall of the streamer receptacle, the lid being capable of enclosing the plurality of spindles and the streamer of each within the housing; and a swivel hanger being coupled to the upper portion of the lid with a coupler, the coupler being positioned through an axial bore of the lid, the swivel hanger having an eyelet being capable of allowing the housing with the rolls therein to suspend from a ceiling, the swivel hanger being capable of allowing the housing to rotate 360 degrees thereabout for release of streamers from the streamer rolls contained therein, each streamer of the streamer rolls capable of being located across the room where the housing being suspended therein.

2. A party wheel comprising:

a housing having a streamer receptacle and a lid, the streamer receptacle having a bottom member and a top edge with a peripheral wall therebetween;

a plurality of rectangular slots being proportionally spaced along the peripheral wall, the peripheral wall being rigid and having a threaded top portion adjacent the top edge;

a plurality of spindles being interconnected to an interior surface of the bottom member of the streamer receptacle, each spindle being spaced from a corresponding slot of the peripheral wall of the streamer receptacle and being in receipt of a streamer roll, each streamer roll capable of being spun about the spindle when one end of the streamer roll being pulled through and away from the corresponding slot;

the lid being capable of enclosing the plurality of spindles and the streamer roll of each within the housing and the one end of each streamer roll being extended through the slot, the lid having a projecting flange therearound and projecting from an upper portion thereof, and the flange of the lid being capable of engaging the top edge of the peripheral wall of the streamer receptacle for securing the lid and receptacle; and a swivel hanger being coupled to an upper portion of the lid for allowing the housing with the rolls therein to suspend from a ceiling.

3. The party wheel as set forth in claim 2 wherein each slot extending vertically between the bottom member and the threaded top portion of the streamer receptacle.

* * * * *